US006641460B2

(12) United States Patent
Obayashi

(10) Patent No.: US 6,641,460 B2
(45) Date of Patent: Nov. 4, 2003

(54) LENS GRINDING APPARATUS

(75) Inventor: Hirokatsu Obayashi, Aichi (JP)

(73) Assignee: Nidek Co., Ltd., Aichi (JP)

( * ) Notice: Subject to any disclaimer, the term of this patent is extended or adjusted under 35 U.S.C. 154(b) by 191 days.

(21) Appl. No.: 09/978,078

(22) Filed: Oct. 17, 2001

(65) Prior Publication Data

US 2002/0072299 A1 Jun. 13, 2002

(30) Foreign Application Priority Data

Oct. 17, 2000 (JP) ..... 2000-321935

(51) Int. Cl.[7] ..... B24B 49/00; B24B 51/00

(52) U.S. Cl. ..... 451/5; 451/8; 451/43; 451/255

(58) Field of Search ..... 451/5, 8, 10, 42, 451/43, 210, 255, 256; 340/680

(56) References Cited

U.S. PATENT DOCUMENTS 4,945,684 A * 8/1990 Wada et al. ..... 451/5
5,053,971 A * 10/1991 Wood et al. ..... 451/5
5,138,770 A 8/1992 Matsuyama
5,148,637 A * 9/1992 Byron ..... 451/5
5,228,242 A 7/1993 Matsuyama
5,257,198 A * 10/1993 van Schoyck ..... 451/5
5,321,915 A * 6/1994 Lecerf et al. ..... 451/6
5,333,412 A 8/1994 Matsuyama
5,347,762 A * 9/1994 Shibata et al. ..... 451/5
5,588,899 A * 12/1996 Gottschald ..... 451/5
5,727,987 A * 3/1998 Gottschlad ..... 451/5
RE35,898 E 9/1998 Shibata et al.
5,803,793 A 9/1998 Mizuno et al.
6,062,947 A 5/2000 Obayashi et al.
6,099,383 A 8/2000 Mizuno et al.

FOREIGN PATENT DOCUMENTS

JP 3-20603 1/1991

* cited by examiner

*Primary Examiner*—Timothy V. Eley
(74) *Attorney, Agent, or Firm*—Sughrue Mion, PLLC

(57) ABSTRACT

In a lens grinding apparatus, an edge corner-portion processing unit has a cutting tool for effecting a facet processing on an edge corner portion of a lens subjected to the finishing process. A region designating unit has a display unit for displaying a shape of the lens before the facet processing on the basis of inputted data. The region designating unit designates a region to be subjected to the facet processing using of the displayed lens shape. A selecting unit selects a facet processing style to be adopted for the designated region of the facet processing from among a plurality of facet processing styles. A computing unit obtains processing data on facet processing on the basis of the selected facet processing style and the position of the edge corner portion in the designated facet processing region.

10 Claims, 11 Drawing Sheets

LENS GRINDING APPARATUS

BACKGROUND OF THE INVENTION

The present invention relates to a lens grinding apparatus for grinding the periphery of an eyeglasses lens.

Designs of eyeglasses frames have become diversified, and rimless eyeglasses which are so-called two-point eyeglasses have also come to be used widely. Further, among the rimless eyeglasses, there has appeared a type which is provided with a fashionable design by performing processing (hereafter referred to as facet processing) in which multifaceted surfaces are formed like a gem by partially cutting outer peripheral corner portions of a front surface and a rear surface of the lens into planar shape. Conventionally, this facet processing has been performed through manual operation by an operator by using a so-called manual grinder having a conical grinding stone.

However, the performing of facet processing into a desired configuration by the manual grinder requires time and expertise, and has not been easy. In addition, the manual operation makes it difficult to uniform the processed configurations of the left and right lenses.

SUMMARY OF THE INVENTION

In view of the above-described conventional art, an object of the invention is to provide a lens grinding apparatus which makes it possible to easily perform facet processing on a lens into a desired configuration.

To overcome the above-described problems, the invention is characterized by having the following features.

(1) A lens grinding apparatus for grinding a peripheral edge of an eyeglasses lens, comprising:

a data input unit which inputs data on a target lens shape of an eyeglasses and layout data for layout of the lens with respect to the target lens shape;

a detecting unit which detects a position of an edge corner portion of the lens after a finishing process on the basis of the data inputted by the data input unit;

an edge corner-portion processing unit which has a cutting tool for effecting a facet processing on the edge corner portion of the lens subjected to the finishing process, and which processes the lens by relatively moving the cutting tool with respect to a lens holding shaft;

a region designating unit which has a display unit for displaying a shape of the lens before the facet processing on the basis of the inputted data, and which designates a region to be subjected to the facet processing using of the displayed lens shape;

a selecting unit which selects a facet processing style to be adopted for the designated region of the facet processing from among a plurality of facet processing styles; and a computing unit which obtains processing data on facet processing on the basis of the selected facet processing style and the position of the edge corner portion in the designated facet processing region.

(2) The lens grinding apparatus according to (1), further comprising:

a correcting unit which corrects the processing data on the basis of the positions of the edge corner portions of a lens front and rear surfaces detected by the detecting unit, so that an edge thickness after the facet processing is prevented from becoming smaller than a predetermined width.

(3) The lens grinding apparatus according to (1), wherein the region designating unit designates the facet processing region by designating an edge position serving as a start point and an edge position serving as an end point.

(4) The lens grinding apparatus according to (1), wherein the region designating unit designates a maximum processing width of the facet processing region.

(5) The lens grinding apparatus according to (1), wherein the display unit displays the designated facet processing region.

(6) The lens grinding apparatus according to (1), wherein the display unit displays in different forms the designated facet processing regions on a lens front surface side and a rear surface side.

(7) The lens grinding apparatus according to (1), wherein the region designating unit uses data on the facet processing region designated for one of left and right lens shapes to designate the facet processing region for the other one of the left and right lens shapes.

(8) The lens grinding apparatus according to (1), wherein the layout data includes data on a position of an optical center of the lens.

(9) The lens grinding apparatus according to (1), wherein the cutting tool includes an abrasive wheel having a processing surface with a predetermined angle of inclination with respect to a rotating shaft thereof.

(10) A lens grinding apparatus for grinding a peripheral edge of an eyeglasses lens, comprising:

a data input unit which inputs data on a target lens shape of an eyeglasses and layout data for layout of the lens with respect to the target lens shape;

a detecting unit which detects a position of an edge corner portion of the lens after a finishing process on the basis of the data inputted by the data input unit;

an edge corner-portion processing unit which has a cutting tool for processing the edge corner portion of the lens subjected to the finishing process, and which processes the lens by relatively moving the cutting tool with respect to a lens holding shaft;

a computing unit which sets a processing amount of the edge corner portion, and which determines corner-portion processing data after the finishing process on the basis of the set processing amount; and a correcting unit which corrects the processing data on the basis of detected positions of edge corner portions of lens front and rear surfaces, so that the edge thickness after edge corner-portion processing is prevented from becoming smaller than a predetermined width.

The present disclosure relates to the subject matter contained in Japanese patent application No. 2000-321935 (filed on Oct. 17, 2000), which is expressly incorporated herein by reference in its entirety.

DESCRIPTION OF THE PREFERRED EMBODIMENT

Figure 1:
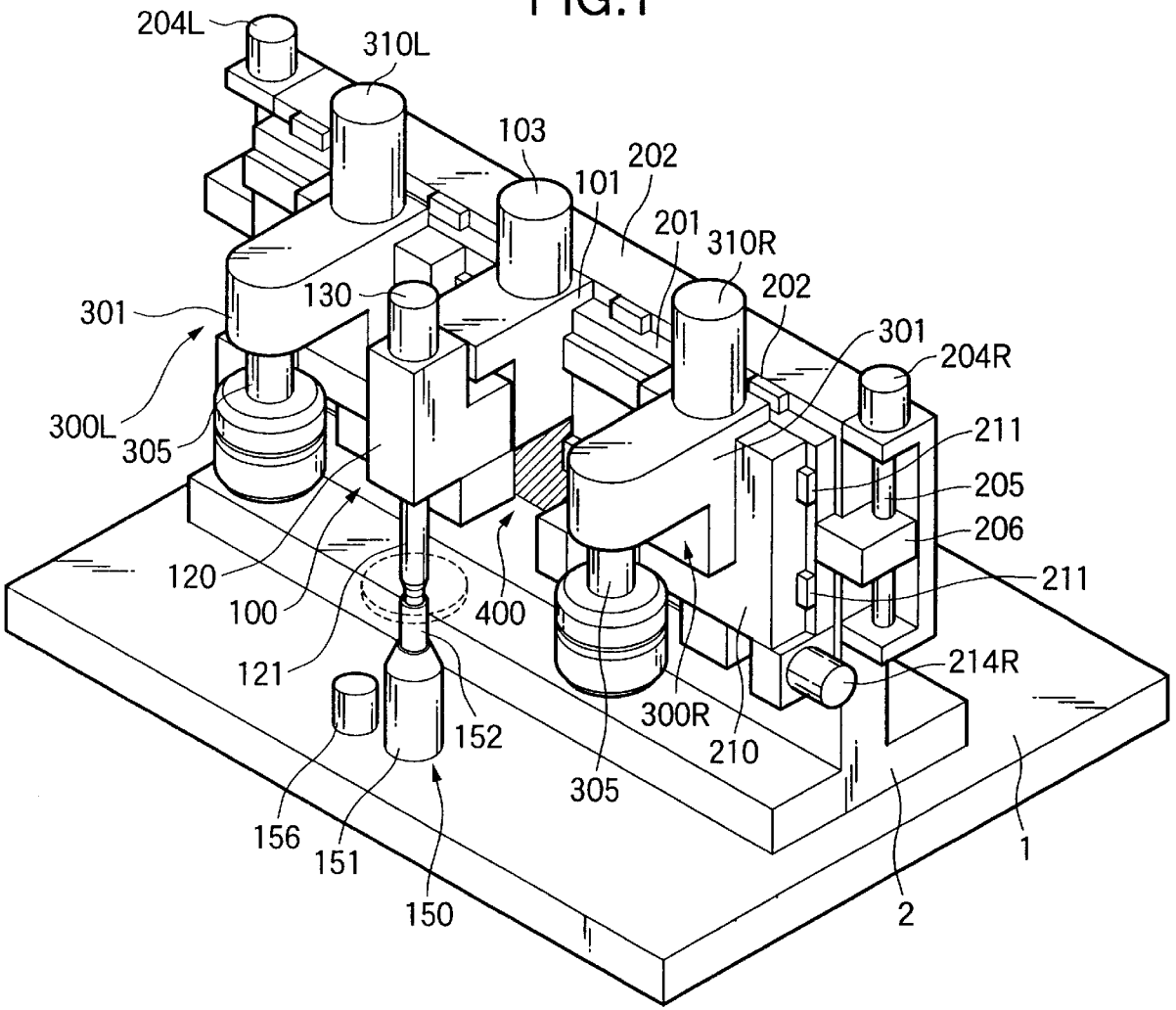
FIG. 1 is a schematic diagram illustrating a processing section of an eyeglasses lens grinding apparatus in accordance with an embodiment of the invention.

Hereafter, a description will be given of an embodiment of the invention with reference to the drawings. FIG. 1 is a diagram illustrating a processing section of an eyeglasses lens processing apparatus.

A sub-base 2 having a lens chuck upper part 100 and lens grinding parts 300R and 300L is fixed on a main base 1. In addition, a lens-shape measuring section 400 is accommodated in the farther side in the center of the sub-base 2.

A fixing block 101 which forms a part of the lens chuck upper part 100 is fixed in the center of the sub-base 2, and a DC motor 103 for vertically moving a chuck shaft holder 120 is mounted on top of the fixing block 101. The motor 103 rotates a vertically extending feed screw. This rotation causes the holder 120 to move vertically while being guided by a guide rail provided between the holder 120 and the fixing block 101. A pulse motor 130 for rotating a chuck shaft 121 is fixed on top of the holder 120. A lens holder 124 is attached to a lower end of the chuck shaft 121 (see FIG. 2).

A chuck shaft 152 which forms a part of a lens chuck lower part 150 is rotatably held by a holder 151 which is fixed to the main base 1, and rotation is transmitted thereto by a pulse motor 156. A cup receiver 159 for mounting a cup fixed to a lens to be processed is attached to an upper end of the chuck shaft 152 (see FIG. 2).

Figure 2:
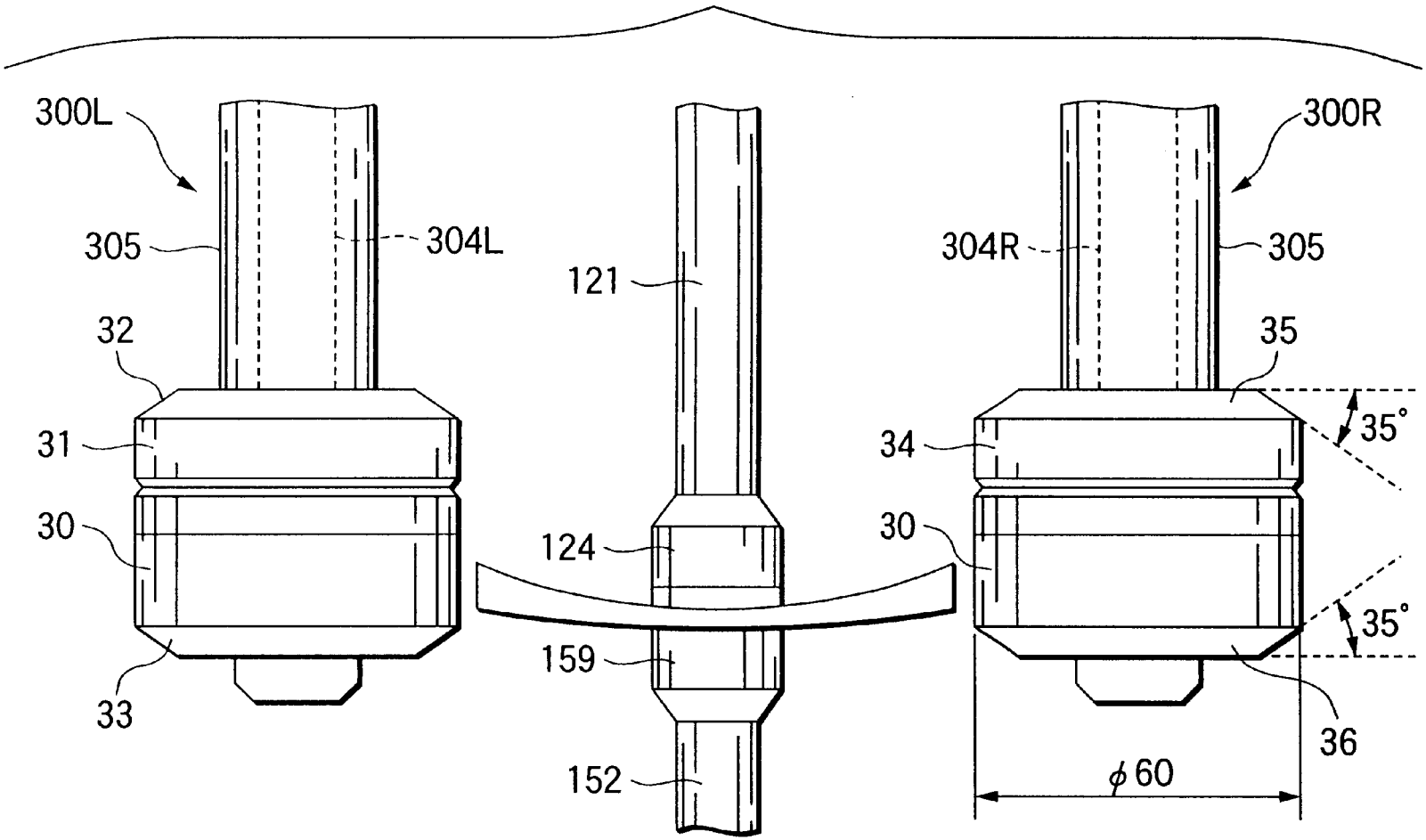
FIG. 2 is a schematic diagram illustrating the arrangement of a group of abrasive wheels.

The lens grinding parts 300R and 300L are bilaterally symmetrical, and a housing 305 for rotatably holding therein rotating shafts 304R and 304L having a group of abrasive wheels 30 to 36, such as those shown in FIG. 2, is attached to the front portion of each shaft support base 301. The rotating shafts 304R and 304L are respectively rotated by servo motors 310R and 310L which are fixed to the respective support bases 301.

As shown in FIG. 2, the rough abrasive wheel 30 and the finishing abrasive wheel 31 having a bevel groove are attached to the rotating shaft 304L of the grinding part 300L. Further, the chamfering abrasive wheel (corner-portion processing abrasive wheel) 32 for processing a lens front surface and having a conical surface and the chamfering abrasive wheel 33 for processing a lens rear surface and having a conical surface are respectively coaxially attached to an upper end face of the finishing abrasive wheel 31 and a lower end face of the rough abrasive wheel 30. The rough abrasive wheel 30, the polishing abrasive wheel 34 having a bevel groove, the chamfering abrasive wheel 35 for polishing the lens front surface and having a conical surface, and the chamfering abrasive wheel 36 for polishing the lens rear surface and having a conical surface are coaxially attached to the rotating shaft 304R of the lens grinding part 300R. These groups of abrasive wheels use abrasive wheels whose diameters are relatively small at 60 mm or thereabouts so as to improve the processing accuracy and ensure the durability of the abrasive wheels. It should be noted that, in this embodiment, the height of the chamfering surfaces (processing surfaces) of the respective chamfering abrasive wheels 32, 33, 35, and 36 is 5 mm, and the angles of inclination of the chamfering surfaces with respect to the horizontal plane are set to 35 degrees.

The grinding parts 300R and 300L are respectively movable in the vertical direction and the horizontal direction with respect to the sub-base 2, and their moving mechanisms are arranged as follows: The grinding part 300R is fixed to a horizontal slide base 210, and the slide base 210 is horizontally movable along two guide rails 211 fixed to a vertical slide base 201. Meanwhile, the slide base 201 is vertically movable along two guide rails 202 fixed to the front surface of the sub-base 2. A nut block 206 is fixed to the slide base 201, and the slide base 201 moves vertically together with the nut block 206 as a ball screw 205 coupled to a rotating shaft of a pulse motor 204R is rotated. The mechanism for horizontally moving the slide base 210 is arranged in the same way as the vertically moving mechanism of the slide base 201, and is actuated by the rotation of a pulse motor 214R.

The mechanism for moving the grinding part 300L is bilaterally symmetrical with the moving mechanism for the grinding part 300R, and it is vertically moved by a pulse motor 204L and is horizontally moved by a pulse motor 214L (not shown in FIG. 1).

It should be noted that, for details of the above-described construction, reference may be had to JP-A-9-254000 and U.S. Pat. No. 5,803,793 filed by or assigned to the present assignee.

Figure 3:
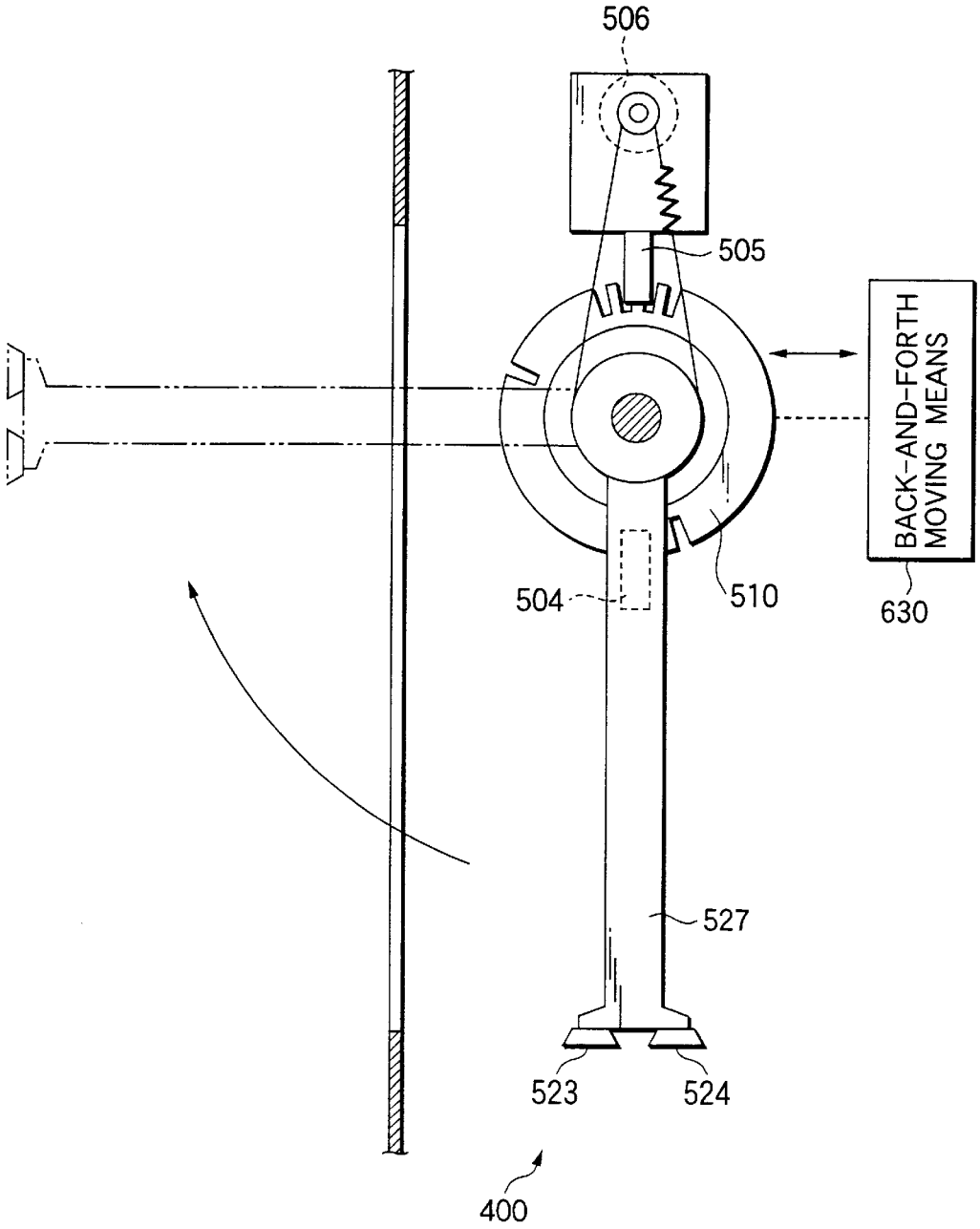
FIG. 3 is a schematic diagram illustrating a lens-shape measuring section.

FIG. 3 is a schematic diagram explaining the lens-shape measuring section 400. The measuring section 400 is comprised of a measurement arm 527 having two feelers 523 and 524; a rotating mechanism including a DC motor (not shown) for rotating the arm 527; a sensor plate 510 and photo switches 504 and 505 for detecting the rotation of the arm 527 to control the rotation of the DC motor; a potentiometer 506 for detecting the amount of rotation of the arm 527 to obtain the shapes of the lens front and rear surfaces, and so on. Since the construction of the measuring section 400 is basically identical to that described in JP-A-3-20603 filed by the present assignee, reference may be had to it for details. It should be noted that, unlike that of JP-A-3-20603, the lens measuring section 400 is moved in the back-and-forth direction (in the direction of the arrow) with respect to the device by a back-and-forth moving means 630, and the amount of its movement is controlled on the basis of radius vector data. In addition, the arm 527 is rotatingly moved from the lower initial position, and measures the lens edge position by causing the feelers 523 and 524 to abut against the lens front refraction surface and rear refraction surface, respectively. A coil spring or the like for canceling the load of the arm 527 in the downward direction is preferably attached to its rotating shaft.

In the measurement of the lens shape (the position of the lens edge), the measuring section 400 is moved back and forth by the back-and-forth moving means 630, and by rotating the lens while causing the feeler 523 to abut against the lens front refractive surface, the shape of the lens front refractive surface is obtained. The feeler 524 is then made to abut against the lens rear refractive surface to obtain its shape. It should be noted that the measurement of the lens shape is performed twice at different positions with respect to the radius vector for each of the lens front and rear surfaces. The first measurement is at the position of the radius vector of the target lens shape, and the second measurement is at a position located on an outer side by a predetermined distance from that position of the radius vector. Consequently, angles of inclination of the lens front and rear surfaces are obtained.

Figure 4:
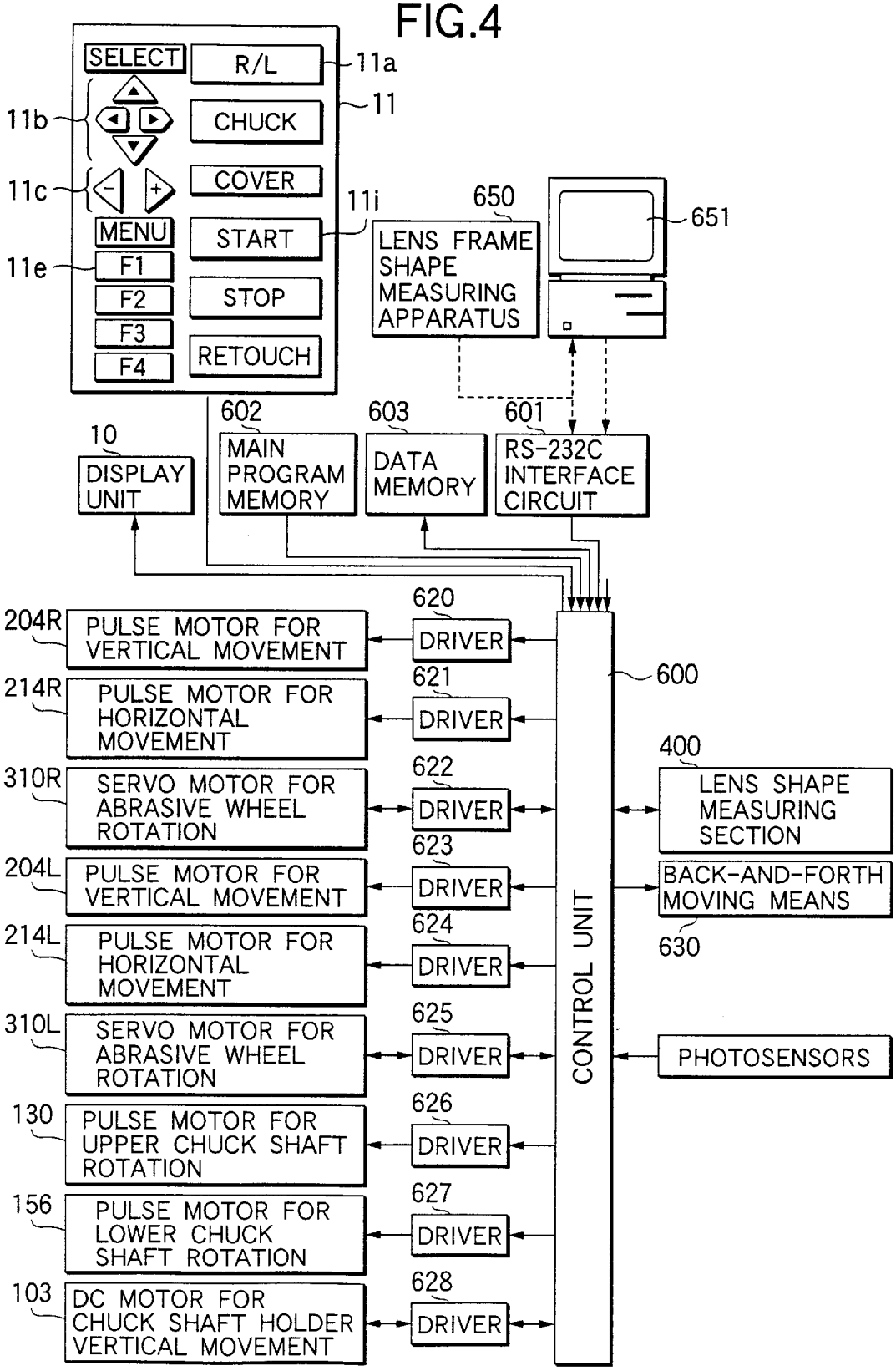
FIG. 4 is a schematic block diagram illustrating a control system of the apparatus.

FIG. 4 is a schematic block diagram illustrating a control system of the apparatus. Reference numeral 600 denotes a control unit for effecting the control of the overall apparatus and computation of processing. Connected to the control unit 600 are a display unit 10 constituted by a color liquid-crystal display, an input unit 11 having various operation switches, the shape measuring section 400, the back-and-forth moving means 630, various photosensors for detecting the initial positions and the like of the grinding parts 300R and 300L, and so on. In addition, various motors for movement and rotation are also connected to the control unit 600 via drivers 620 to 628. Reference numeral 601 denotes an interface circuit used for transmission and reception of data. Connected to the interface circuit 601 are a lens-frame-shape measuring apparatus 650 (for details of the construction of this apparatus and the measuring operation, refer to JP-A-4-93164 or U.S. Pat. No. 5,333,412, etc.) and a computer 651 for managing the lens processing information. Numeral 602 denotes a main program memory in which a program and the like for operating the apparatus are stored, and numeral 603 denotes a data memory for storing inputted data, lens measurement data, and the like.

Next, a description will be given of a method of calculating chamfering (edge corner-portion processing) data.

In the calculation of the chamfering data, edge position data after finishing is determined, and the chamfering data is obtained on the basis of this edge position data. Here, a description will be given by citing the lens front surface side after flat finishing as an example.

Figure 5:
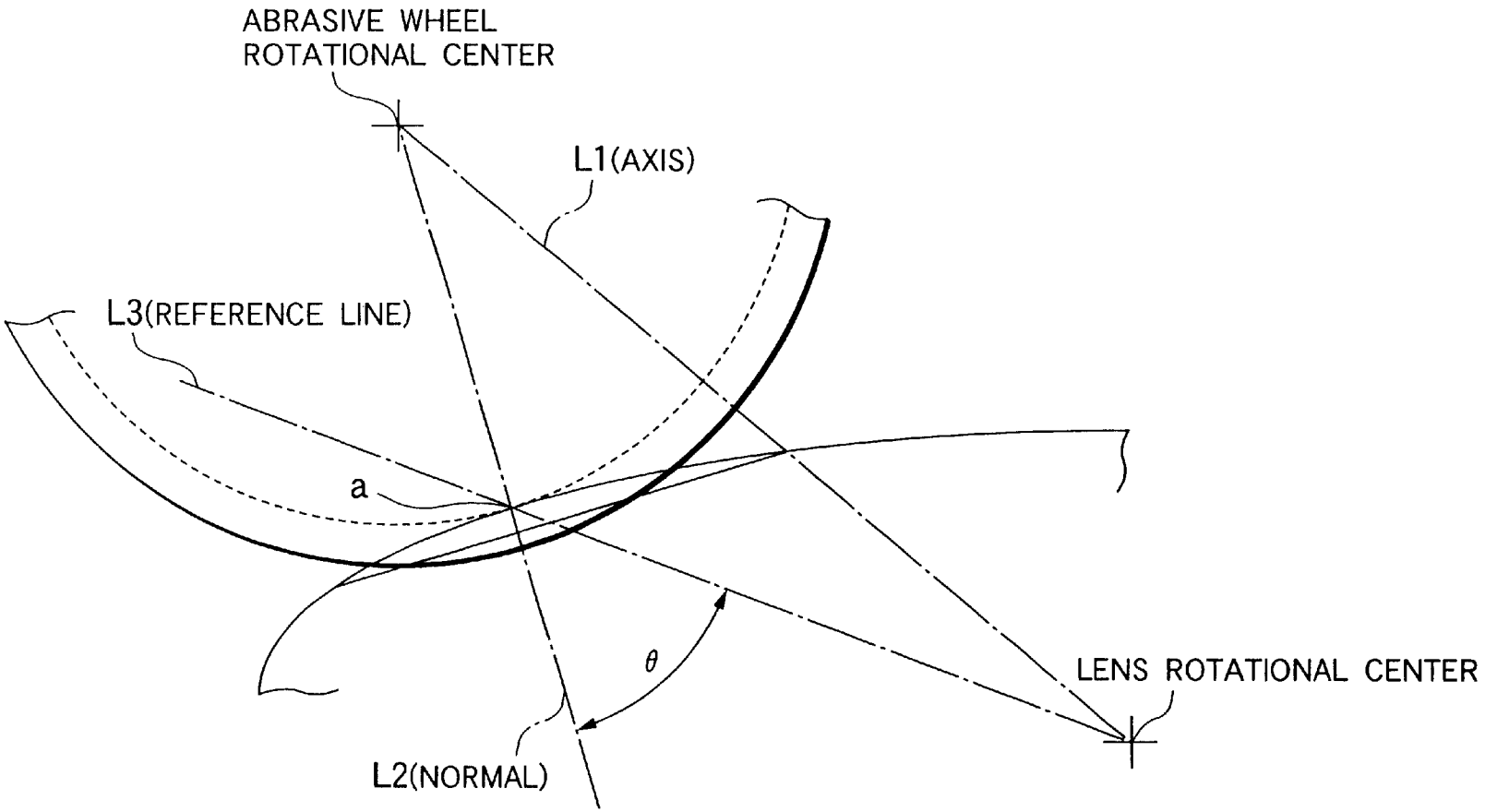
FIG. 5 is a diagram for explaining the relationship between a chamfering abrasive wheel and a lens.

FIG. 5 is a diagram explaining the relationship between the chamfering abrasive wheel and the lens, and it is assumed that a line connecting the rotational center of the lens and the rotational center of the abrasive wheel at the time when a processing point a on the edge end face is processed is an axis L1, that a line connecting the processing point a and the rotational center of the abrasive wheel is a normal L2, and that a line connecting the processing point a and the rotational center of the lens is a reference line L3, and that θ=angle between the normal L2 and the reference line L3

Figure 6:
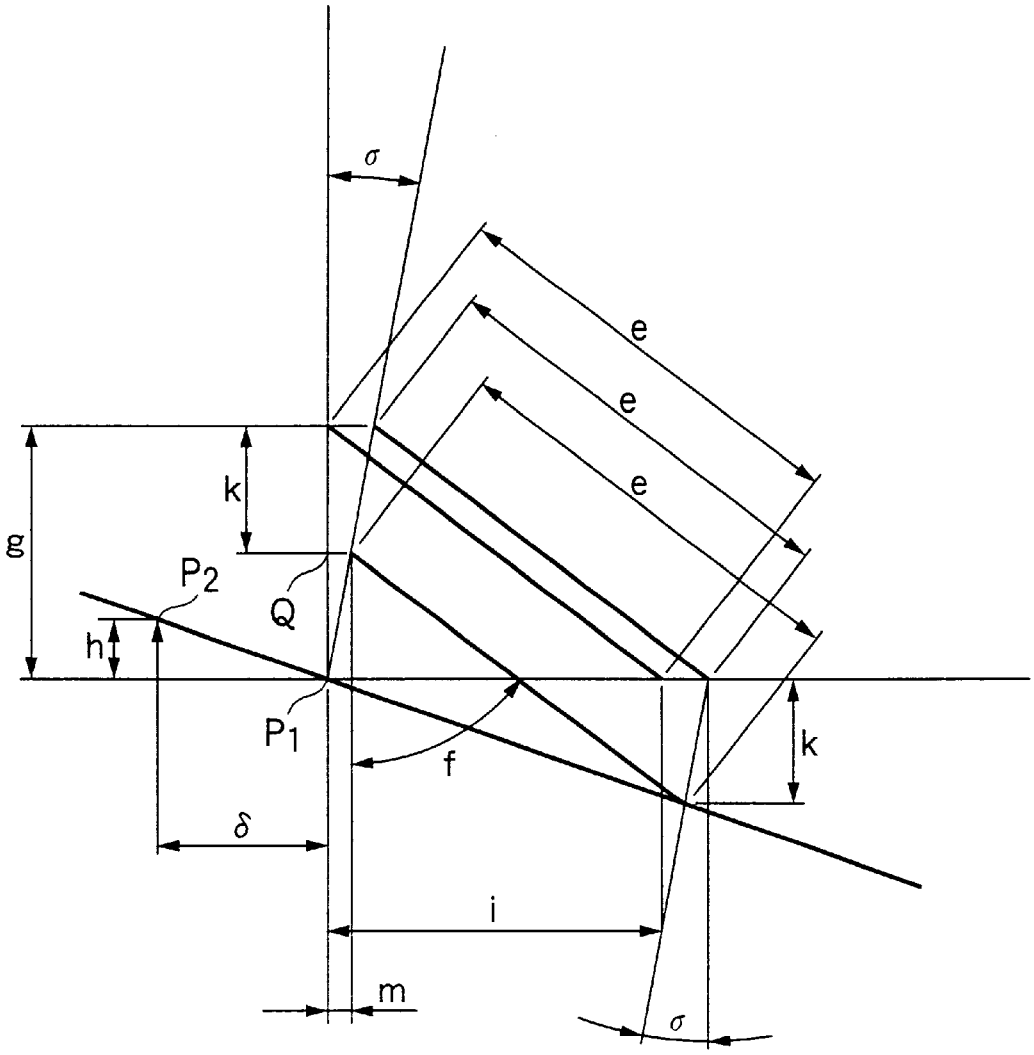
FIG. 6 is a diagram for explaining the calculation of processing data on chamfering (corner portion)

In the chamfering, a cross-sectional shape in the direction of the reference line L3 is considered, as shown in FIG. 6.

As the edge position data on the lens front surface side, the data on the target lens shape can be used as it is. In FIG. 6, P1 denotes an edge position which is obtained in the first measurement of the lens edge position measurement, while P2 denotes an edge position (a position located on an outer side by a predetermined distance δ from the position of the first measurement) which is obtained in the second measurement. Reference character h denotes the distance between the first measurement position and the second measurement position in the direction of the optical axis of the lens (in the direction of the rotational axis of the lens), and if the inclination of the lens surface is approximately considered as a straight line, its inclination can be determined from δ and h.

Here, in the processing of an edge corner portion by the chamfering abrasive wheel, a case is first considered in which the lens surfaces are flat, and the lens edge face is also flat. Reference character i denotes a distance component of facet processing which is designated from the edge position P1 in the direction of the reference line L3; g, an offset component from the edge position P1 in the direction of the optical axis of the lens; f, a correction angle of an angle of inclination F (which is a known value, i.e., 90°−35°=55° in this embodiment) of the chamfering abrasive wheel in the direction of the reference line L3; σ, a correction angle of the inclination of the lens edge face with respect to an angle of inclination ρ (this value is known and stored in the main program memory) of the finishing abrasive wheel; and e, a chamfering width in a case where the lens rear surface is flat. As a method for conforming to the distance component of facet processing (for conforming to the designated chamfering width), the processing surface is moved in parallel such that the chamfering width e which is equal to the case where both the lens front surface and the lens end face are flat will be obtained, so as to determine an offset correction amount k.

Figure 7:
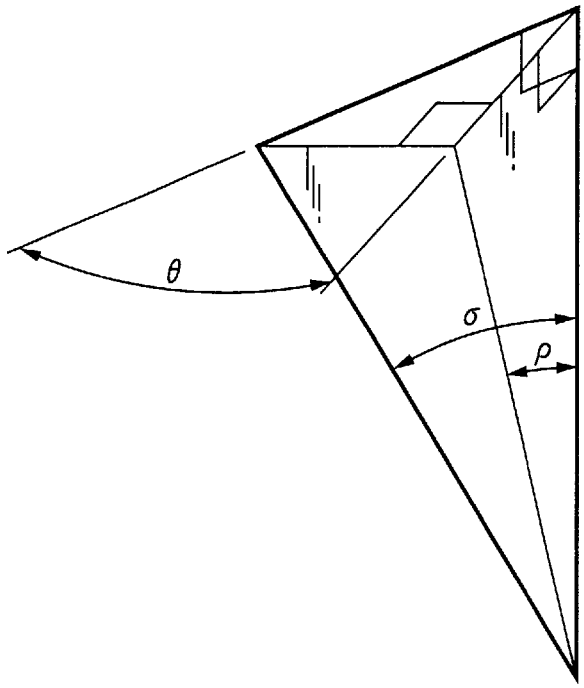
FIG. 7 is a diagram for explaining the calculation of a correction angle a with respect to an angle of inclination p of a processing surface of a finishing abrasive wheel.

For this reason, the correction angle σ of the inclination of the lens edge face is first determined. In a case where the lens is processed with the angle of inclination ρ of the processing surface of the finishing abrasive wheel, the angle of inclination in the direction of the normal L2 as it is becomes the angle of inclination ρ, but if the cross-sectional shape in the direction of the reference line L3 is considered, its correction angle σ can be obtained from FIG. 7 as $$\sigma=\arctan(\tan \rho/\cos \theta)$$

This correction angle σ is determined at respective places in correspondence with the angle of the radius vector.

Likewise, the correction angle f with respect to the angle of inclination F of the chamfering abrasive wheel becomes $$f=\arctan(\tan F/\cos \theta)$$

Then, from FIG. 6, the offset correction amount k is determined as

Formula 1

It should be noted that in a case where the correction angle σ is sufficiently small, the offset correction amount k may be set as follows (in particular, the effect on the correction of the lens front surface side is slight).

Formula 2

From the above, the position in the direction of the optical axis of the lens of the chamfering point Q using as a reference the edge position P1 on the lens front surface side can be obtained from g−k. In addition, the position in the radial direction of the lens of the chamfering point Q using as a reference the edge position P1 can be obtained from $$m=(g-k)\cdot\tan \sigma$$

where m is a correction amount thereof. Processing data on the corner portion can be obtained by determining this correction amount for respective places in correspondence with the angle of the radius vector.

Figure 8:
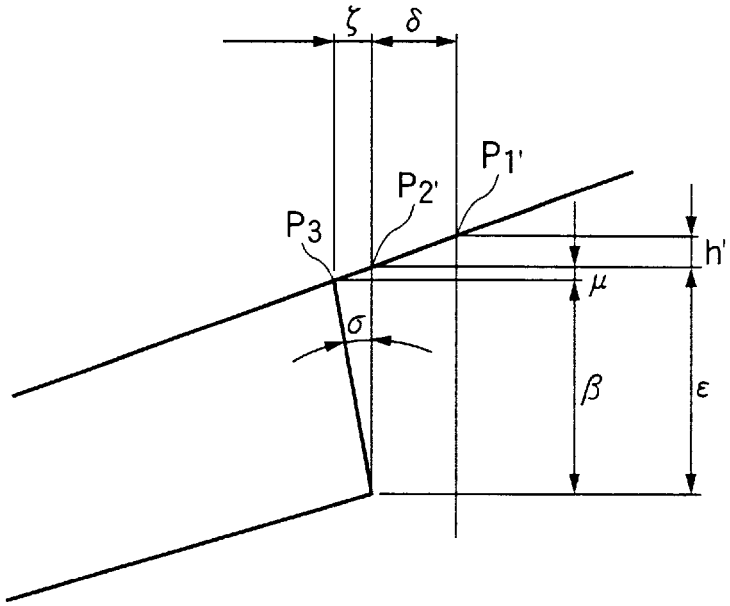
FIG. 8 is a diagram for explaining the calculation of an edge position on a lens rear surface after a finishing process.

Processing data on the edge corner portion on the lens rear surface side can be also obtained by a similar method. It should be noted that since the edge position on the lens rear surface changes due to the correction angle σ of the inclination of the lens end face, as shown in FIG. 8, the cross-sectional shape in the direction of the reference line L3 is considered, and its edge position P3 is determined as follows: In FIG. 8, P1' denotes an edge position which is obtained in the first measurement of the edge position measurement on the lens rear surface side, while P2' denotes an edge position which is similarly obtained in the second measurement on the lens rear surface side. Here, h' in FIG. 8 is obtained from the result of measurement in the edge position measurement, and ϵ can be obtained from the results of the first measurement on the lens front surface side and rear surface side. Therefore, if the rear surface curve is approximately considered as a straight line, a correction amount $\mu$ in the direction of the optical axis of the lens and a correction amount ζ in the radial direction of the lens at the edge position P3 can be obtained as follows:

Formula 3

By determining these correction amounts for respective places in correspondence with the angle of the radius vector, edge position data on the rear surface side after finishing can be obtained, and can be used in the calculation of processing data on the edge corner portion on the lens rear surface side as well.

Next, the operation of the apparatus will be discussed. The target lens shape (eyeglasses frame shape) of the lens to be subjected to facet processing is measured by the frame shape measuring apparatus 650 and is inputted to the apparatus. In the case of the rimless eyeglasses, the edge of a dummy lens fitted in the eyeglasses is traced to obtain the target lens shape. In addition, in a case where the target lens shape has been stored in the computer 651, the data on the target lens shape is inputted from the computer 651.

If the target lens shape is inputted, a layout screen (not shown) for inputting processing conditions and the position of the optical center with respect to the target lens shape is displayed on the display unit 10. Processing conditions including the types of lens material, processing mode, chamfering, and the like are inputted by switches on the input unit 11. Here, the mode is set to the flat processing mode, and facet processing is selected for chamfering. In addition, layout data including FPD (the distance between centers of eyeglasses frame portions), the wearer's pupillary distance (PD), the position (height) of the optical center with respect to the target lens center, and the like is inputted by operating the switches in accordance with input items displayed on the layout screen.

After the input of the data, the lens is fitted on the chuck shaft 152 side, and a START switch 11*i* is pressed to start the operation of the apparatus. The chuck shaft 121 is then lowered to chuck the lens, and the measuring section 400 is driven to measure the lens shape of the lens front surface and rear surface on the basis of the radius vector information on the target lens shape. The measurement of the lens shape is performed twice for each of lens front surface and rear surface at different positions with respect to the radius vector, as described above. Accordingly, the angle of inclination of each of the lens front surface and the lens rear surface is obtained.

Figure 9:
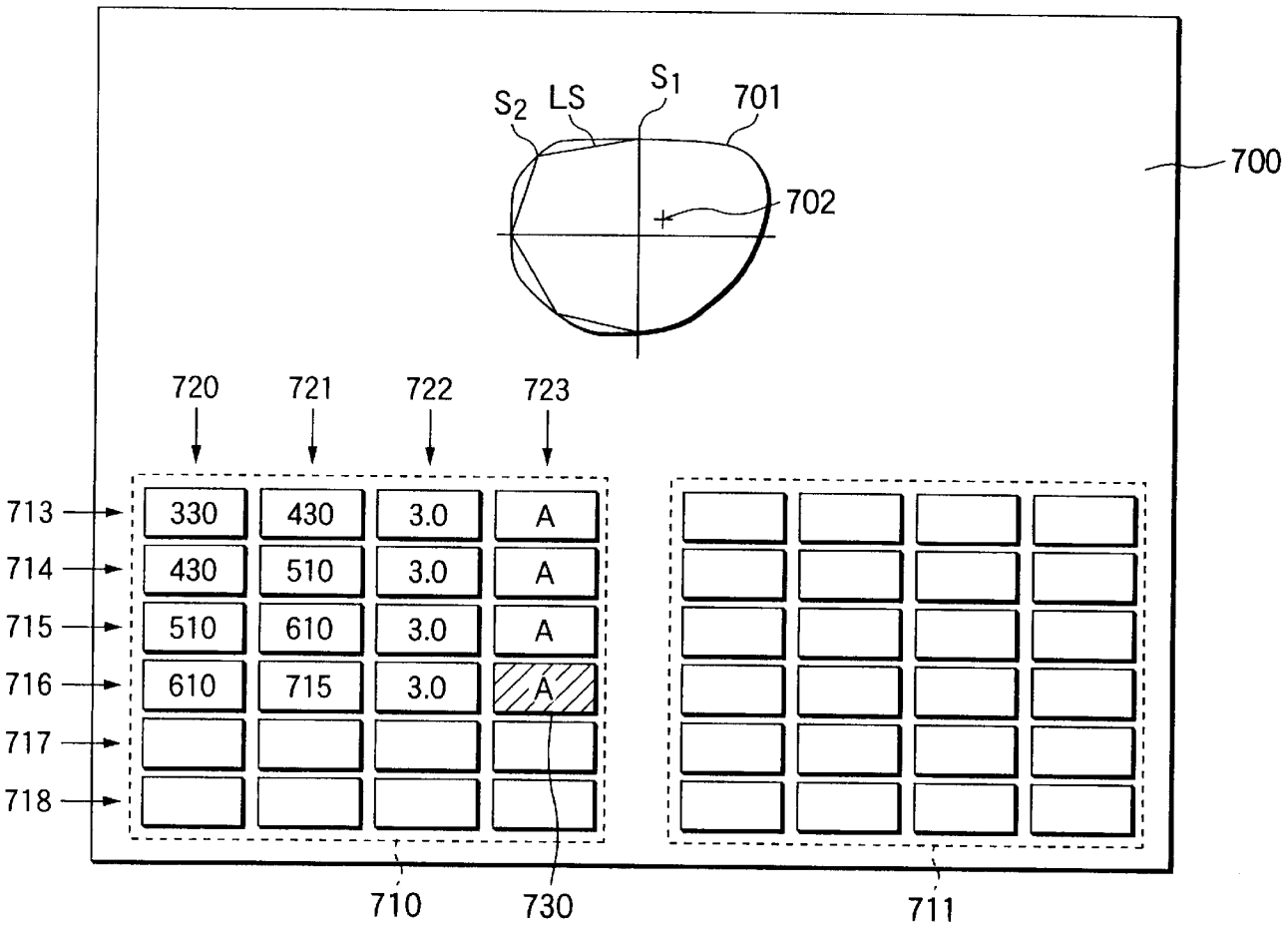
FIG. 9 is a diagram illustrating an example of a screen for entering setting data for performing facet processing.

After the measurement of the lens shape, the screen on the display unit 10 is changed over to a screen for inputting setting data for performing facet processing. FIG. 9 shows an example of the screen. A figure 701 of the target lens shape showing the appearance and shape of the lens is displayed on the upper side of a screen 700. Reference numeral 702 denotes a mark showing the position of the optical center which has been set by the input of the layout. Columns for entering data for setting facet processing are provided on the lower side of the screen, and setting data for the lens front surface is inputted in each column of a dotted-line section 710 on the left-hand side of the screen, while setting data for the lens rear surface is inputted in each column of a section 711 on the right-hand side. In this apparatus, the arrangement provided is such that the edge positions of the target lens shape are designated as two points, i.e. a start point and an end point, so as to set a region to which facet processing is to be applied. To allow the processing region designated by these two points to be set at 6 places, input columns in a first region 713 to a sixth region 718 are provided in that order from the top.

In the input columns in the first region 713 to the sixth region 718 for the lens front surface, a first column 720 from the left is a column for entering a start point (edge position) of the region to be subjected to facet processing, and a second column 721 from the left is a column for entering an end point (edge position) thereof. The target lens shape data is arranged to be obtained on the basis of 1000 points (points obtained by dividing the entire periphery into units of 0.360), and the start point and the end point are respectively inputted by the number of points with respect to 1000 points. In the case of the lens for the right eye, the number of points increases counterclockwise by using the horizontal direction as a reference and by using the optical center based on the input of the layout data as the center. In the illustrated example, the start point of the first region is inputted as 330 points, while the end point is inputted as 430 points. If the positions of the start point (S1) and the end point (S2) are inputted with respect to each processing region, lines (a line LS), each connecting the respective two points is displayed on the lens shape figure 701.

In the input columns in the respective regions 713 to 718, a third column 722 from the left is a column for entering a maximum chamfering width. In this embodiment, the maximum chamfering width is designated by a value (the value of i in FIG. 6) of the reference line L3, and a setting can be made up to a maximum of 4 mm in the relationship with the width of the chamfering abrasive wheel, but may be calculated as the values of the offset amount g and chamfering width e in FIG. 6. A fourth column 723 from the left is an input column for setting the style of facet processing. As for this processing style, four styles A to D are stored in the memory 602, and a desired one is selected from among them and is inputted.

In inputting in each column, a highlighted cursor 730 is first moved by pressing a direction switch 11*b* on the input unit 11 to select an input column, and the value of each column is set by increasing or decreasing with a "−/+" switch 11*c*. The style of facet processing is consecutively changed over by similarly pressing the switch 11*c*.

The input columns of the section 710 for setting the processing of the lens rear surface are also arranged in the same order as that for the lens front surface, so that a description thereof will be omitted. It should be noted that, in the lens shape figure 701, the line LS connecting the two points indicating a processing-designating region on the lens front surface side is displayed in blue color, while the line LS indicating a processing-designating region on the lens rear surface side is displayed in red color, so as to make them visually discernable.

A description will be given of the styles (A, B, C, and D) of facet processing.

Style A

Figure 10A:
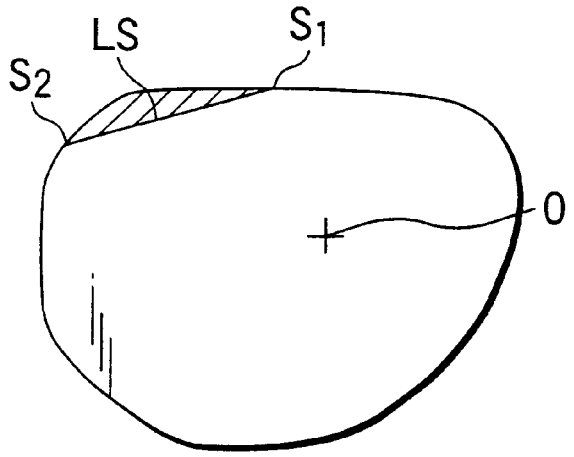
FIGS. 10A and 10B are diagrams for explaining a style A in the form of facet processing.
Figure 10B:
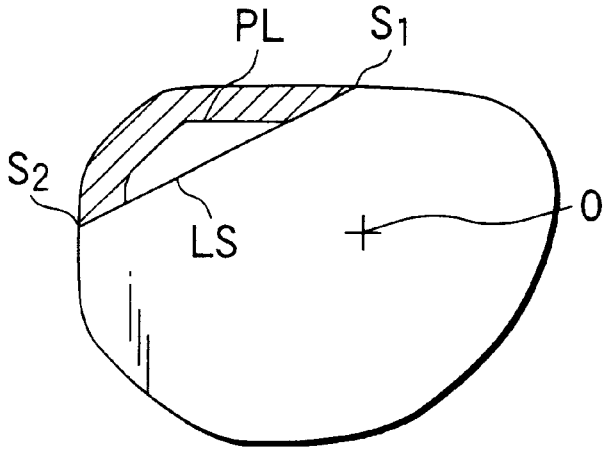

FIGS. 10A and 10B are diagrams for explaining the style A in the form of facet processing. The basic of the style A is a form in which an edge corner portion is processed such that the lens surface side after processing forms the straight line LS connecting the start point S1 and the end point S2 designated on the lens edge positions (such that the portion between the two points designated by S1 and S2 is viewed as a straight line), as shown in FIG. 10A. The hatched portion becomes an inclined surface where the corner portion is ground by the chamfering abrasive wheel 32 for lens front-surface processing. Here, as for the region which exceeds the set maximum chamfering width (a value set in the aforementioned third column 722) when the straight line LS connecting the two points, i.e. the start point S1 and the end point S2, is drawn as shown in FIG. 10B, the edge corner portion is processed by that maximum chamfering width.

Style B

Figure 11:
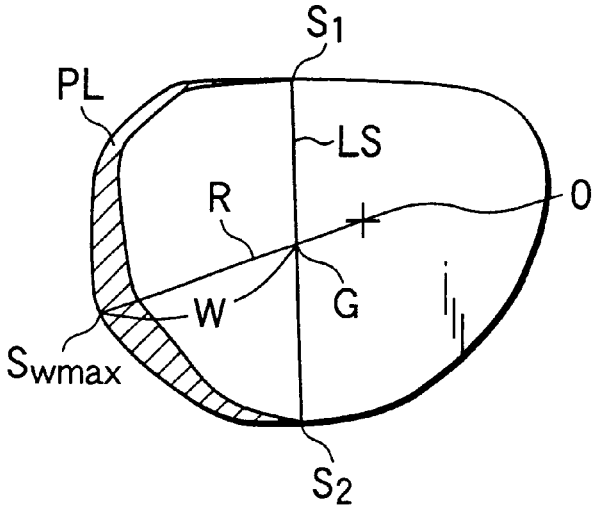
FIG. 11 is a diagram for explaining a style B in the form of facet processing.

FIG. 11 is a diagram for explaining the style B. If it is assumed that the straight line connecting the start point S1 and the end point S2 is set as LS, and that the line of the radius vector of the target lens shape using the processing center O as a reference is set as R, the edge position $S_{WMAX}$ is defined in the following manner. The edge position where the length W of its radius vector line R from the edge position to a point of intersection, G, between the straight line LS and the radius vector line R becomes maximum is defined as $S_{WMAX}$. In the style B, the edge corner portion is processed with the chamfering width gradually made larger from the start point S1 so that the chamfering width becomes maximum at this edge position $S_{WMAX}$. When the edge position $S_{WMAX}$ has been reached, the edge corner portion is processed so that the chamfering width becomes gradually smaller up to the end point S2.

In addition, the chamfering width at each edge position where the chamfering width is made gradually larger from the start point S1 to the edge position $S_{WMAX}$ is determined as follows: In the edge coordinate position expressed by 1000 points over the entire periphery of the target lens shape, it is assumed that the total number of points of the target lens shape from the start point S1 to the edge position $S_{WMAX}$ is M, and an incremental width Δd between points is determined from $$\Delta d = \text{maximum } W/M$$

Then, the width which is consecutively incremented by Δd from the start point S1 to $S_{WMAX}$ becomes the chamfering width at each edge position.

Likewise, as for the chamfering width at each edge position where the chamfering width is made gradually smaller from the edge position $S_{WMAX}$ to the end point S2, it is assumed that the total number of points from the edge position $S_{WMAX}$ to the end point S2 is M', and an decremental width Δd' between points is determined from $$\Delta d' = \text{maximum } W/M'$$

Then, the width which is consecutively decremented by Δd' from the edge position $S_{WMAX}$ to the end point S2 becomes the chamfering width at each edge position.

Style C

Figure 12:
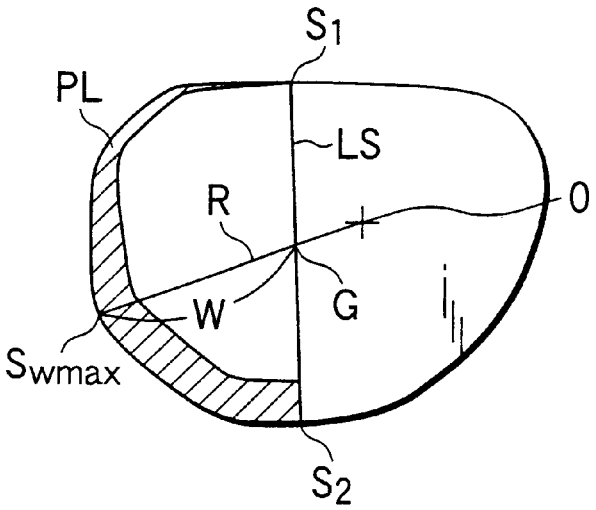
FIG. 12 is a diagram for explaining a style C in the form of facet processing.

Style C is a form in which, in contrast to the above-described style B, the edge corner portion is processed such that the chamfering width is gradually made larger from the start point S1, and after the edge position $S_{WMAX}$ where the chamfering width becomes maximum has been reached, the edge corner portion is processed up to the end point S2 with that maximum chamfering width (see FIG. 12).

Style D

Figure 13:
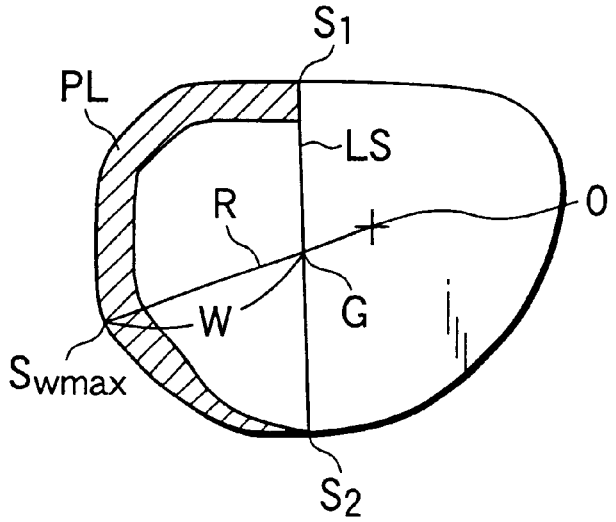
FIG. 13 is a diagram for explaining a style D in the form of facet processing.

Style D is a form in which, reversely to the above-described style C, the edge corner portion is processed such that the chamfering width is gradually made larger from the end point S2, and after the edge position $S_{WMAX}$ where the chamfering width becomes maximum has been reached, the edge corner portion is processed up to the start point S1 with that maximum chamfering width (see FIG. 13).

It should be noted that the style C and the style D are provided so as to be used in combination of the two styles or in combination with the style A.

In the above-described manner, with respect to the lens front surface side and the lens rear surface side, by effecting the designation of each processing region based on the start point S1 and the end point S2, the setting of its maximum chamfering width, and the selection of the processing style among the styles A to D, the configuration of facet processing with respect to the target lens shape is designed. If an F1 switch 11*e* is pressed, processing data on the edge corner portion is calculated for each designated region in the above-described manner. A simulated processing line PL (see FIG. 11 and the like) is displayed on the target lens shape figure 701 instead of the straight line connecting the start point and the end point. The lens front surface side and the lens rear surface side are respectively distinguished in blue color and red color so as to be discernable on the lens figure. In the case of the basic pattern of the style A (see FIG. 10A), the straight line per se connecting S1 and S2 becomes the processing line.

Here, in cases where the edge thickness of the lens is small or in cases where the processing of the lens front surface side and the processing of the lens rear surface side overlap, if the chamfering surface is made large as designated, there are cases where the lens diameter becomes small. In such a case, to ensure that the target lens shape does not become small, the designated processing configuration is corrected so that the portion which is estimated to have the smallest edge thickness after processing does not become smaller than a predetermined length t (e.g., 1 mm). For example, the correction is made as follows.

Figure 14:
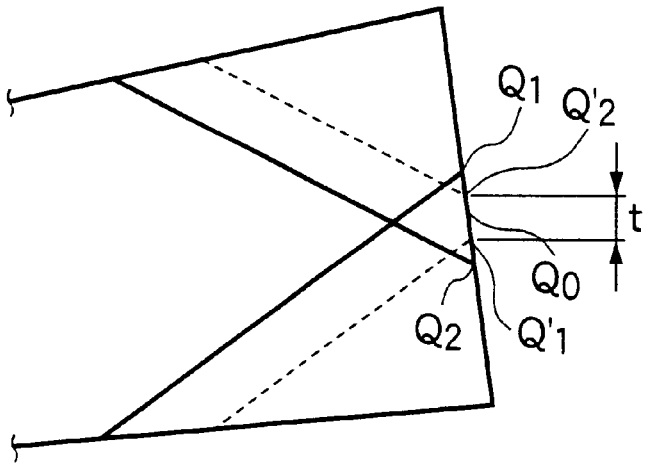
FIG. 14 is a diagram for explaining the correction of a chamfering point in a case where the edge thickness becomes small.

In FIG. 14, Q1 denotes a processing point determined by the calculation of edge corner-portion processing on the lens front surface side, and Q2 denotes a processing point determined by the calculation of edge corner-portion processing on the lens rear surface side. If processing is effected in this state, each processing surface becomes as indicated by the solid line, and the obtained lens shape becomes small in size. Accordingly, correction of each processing point is effected such that after a central point Q0 between the processing points Q1 and Q2 is determined, a processing point Q1' on the lens front surface side is positioned at a position 0.5 mm spaced apart from that central point Q0 toward the front surface side, while a processing point Q2' on the lens rear surface side is similarly positioned at a position 0.5 mm spaced apart from that central point Q0 toward the rear surface side. Each processing surface comes to be located at the position indicated by the dotted line. Incidentally, the same also applies to a case where facet processing is effected with respect to only one of the lens front surface side and rear surface side. In this case as well, a predetermined length (t=1 mm) is secured from the normal chamfering point provided for the edge corner portion.

After a desired facet processing configuration has been confirmed, if the START switch 11*i* is pressed, processing is started. First, rough processing is performed. In rough processing, after both of the left and right rough abrasive wheels 30 are brought to the heightwise position of the lens, the lens grinding parts 300R and 300L are respectively slid to the chuck shaft side of the lens. The left and right rough abrasive wheels 30, while rotating, gradually grind the lens from two directions. At this time, the amounts of movement of the rough abrasive wheels 30 toward the lens side (chuck shaft side) are respectively controlled independently on the basis of rough processing data obtained from the radius vector data.

Next, the control unit 600 performs flat finishing by controlling the height of the flat portion of the finishing abrasive wheel 31 and its movement toward the lens on the basis of the processing data on flat finishing. Upon completion of the finishing process, the operation proceeds to facet processing and the chamfering process for a region for which facet processing is not designated. The control unit 600 then performs the processing of the edge corner portion by controlling the movement of the chamfering abrasive wheel 32 for the front surface and the chamfering abrasive wheel 33 for the rear surface in the vertical direction (in the direction of the rotating shaft) and in the direction of the lens (in the direction perpendicular to the rotating shaft) on the basis of the above-described facet processing data for the designated regions and the chamfering data (e.g., set in advance as an offset of g=0.2 mm) for the other regions which are stored in the memory 603.

After the chamfering process for finishing has been effected, a polishing process for flat finishing is performed by the polishing abrasive wheel 34, and the polishing process of the edge corner portions is subsequently performed by the chamfering abrasive wheel 35 for the polishing process for the front surface and the chamfering abrasive wheel 36 for the polishing process for the rear surface.

It should be noted that, as a cutting tool for effecting the processing of the edge corner portions, it is possible to use an end mill or the like in place of the above-described chamfering abrasive wheels. The polishing process may be effected by buffing since it is final finishing.

Upon completion of the lens for the right eye, an R/L changeover switch 1*a* on the input unit 11 is pressed to perform the processing of the lens for the left eye. At this time, the target lens shape data is mirror-inverted between the left and the right. Similarly, the input values for facet processing shown in FIG. 9 are also mirror-inverted between the left and the right. Consequently, the facet processing configuration of the lens for the left eye can be made similar to that of the lens for the right eye.

It should be noted that if the processing data on the lens itself is available, the detection of the edge position of the lens may be effected only by the calculation instead of effecting the lens shape measurement.

As described above, in accordance with the present invention, facet processing into a desired configuration can be performed easily.

$$k = \frac{g(\tan f + \tan\sigma)}{\tan\sigma + \frac{\delta}{h}} \qquad \text{Formula 1}$$

$$k = \frac{gh}{\delta}\tan f \qquad \text{Formula 2}$$

$$\beta\tan\sigma = \mu\frac{\delta}{h} \quad \beta = \varepsilon - \mu \qquad \text{Formula 3}$$

$$\mu = \frac{\varepsilon\tan\sigma}{\frac{\delta}{h} + \tan\sigma}$$

$$\zeta = \mu\frac{\delta}{h'}$$

What is claimed is:

1. A lens grinding apparatus for grinding a peripheral edge of an eyeglasses lens, comprising:

a data input unit which inputs data on a target lens shape of an eyeglasses and layout data for layout of the lens with respect to the target lens shape;

a detecting unit which detects a position of an edge corner portion of the lens after a finishing process on the basis of the data inputted by the data input unit;

an edge corner-portion processing unit which has a cutting tool for effecting a facet processing on the edge corner portion of the lens subjected to the finishing process, and which processes the lens by relatively moving the cutting tool with respect to a lens holding shaft;

a region designating unit which has a display unit for displaying a shape of the lens before the facet processing on the basis of the inputted data, and which designates a region to be subjected to the facet processing using of the displayed lens shape;

a selecting unit which selects a facet processing style to be adopted for the designated region of the facet processing from among a plurality of facet processing styles; and a computing unit which obtains processing data on facet processing on the basis of the selected facet processing style and the position of the edge corner portion in the designated facet processing region.

2. The lens grinding apparatus according to claim 1, further comprising:

a correcting unit which corrects the processing data on the basis of the positions of the edge corner portions of a lens front and rear surfaces detected by the detecting unit, so that an edge thickness after the facet processing is prevented from becoming smaller than a predetermined width.

3. The lens grinding apparatus according to claim 1, wherein the region designating unit designates the facet processing region by designating an edge position serving as a start point and an edge position serving as an end point.

4. The lens grinding apparatus according to claim 1, wherein the region designating unit designates a maximum processing width of the facet processing region.

5. The lens grinding apparatus according to claim 1, wherein the display unit displays the designated facet processing region.

6. The lens grinding apparatus according to claim 1, wherein the display unit displays in different forms the designated facet processing regions on a lens front surface side and a rear surface side.

7. The lens grinding apparatus according to claim 1, wherein the region designating unit uses data on the facet processing region designated for one of left and right lens shapes to designate the facet processing region for the other one of the left and right lens shapes.

8. The lens grinding apparatus according to claim 1, wherein the layout data includes data on a position of an optical center of the lens.

9. The lens grinding apparatus according to claim 1, wherein the cutting tool includes an abrasive wheel having a processing surface with a predetermined angle of inclination with respect to a rotating shaft thereof.

10. A lens grinding apparatus for grinding a peripheral edge of an eyeglasses lens, comprising:

a data input unit which inputs data on a target lens shape of an eyeglasses and layout data for layout of the lens with respect to the target lens shape;

a detecting unit which detects a position of an edge corner portion of the lens after a finishing process on the basis of the data inputted by the data input unit;

an edge corner-portion processing unit which has a cutting tool for processing the edge corner portion of the lens subjected to the finishing process, and which processes the lens by relatively moving the cutting tool with respect to a lens holding shaft;

a computing unit which sets a processing amount of the edge corner portion, and which determines corner-portion processing data after the finishing process on the basis of the set processing amount; and a correcting unit which corrects the processing data on the basis of detected positions of edge corner portions of lens front and rear surfaces, so that the edge thickness after edge corner-portion processing is prevented from becoming smaller than a predetermined width.

* * * * *